US006665505B2

(12) United States Patent
Meetze, Jr. et al.

(10) Patent No.: US 6,665,505 B2
(45) Date of Patent: Dec. 16, 2003

(54) DRY INK REPLENISHMENT BOTTLE WITH INTERNAL PLUG AGITATION DEVICE

(75) Inventors: Murray O. Meetze, Jr., Rochester, NY (US); Debora M. Litwiller, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 116 days.

(21) Appl. No.: 10/022,230

(22) Filed: Dec. 20, 2001

(65) Prior Publication Data

US 2003/0116923 A1 Jun. 26, 2003

(51) Int. Cl.[7] ..... G03G 15/08
(52) U.S. Cl. ..... 399/106; 399/263
(58) Field of Search ..... 399/106, 254, 399/262, 263; 366/247

(56) References Cited

U.S. PATENT DOCUMENTS

| | | | | |
|---|---|---|---|---|
| 4,739,907 A | | 4/1988 | Gallant | 222/240 |
| 5,435,461 A | * | 7/1995 | Smith et al. | 222/45 |
| 5,495,323 A | | 2/1996 | Meetze, Jr. | 355/260 |
| 5,500,719 A | | 3/1996 | Ichikawa et al. | 355/260 |
| 5,576,816 A | | 11/1996 | Staudt et al. | 355/260 |
| 5,613,177 A | * | 3/1997 | Meetze, Jr. et al. | 399/263 |
| 5,678,121 A | | 10/1997 | Meetze, Jr. et al. | 399/12 |
| 5,903,806 A | | 5/1999 | Matsuoka et al. | 399/258 |
| 5,942,484 A | | 8/1999 | Roetker et al. | 510/426 |
| 6,137,972 A | | 10/2000 | Playfair et al. | 399/106 |
| 6,169,864 B1 | * | 1/2001 | Baxendell et al. | 399/106 |
| 6,363,232 B1 | * | 3/2002 | Flaherty | 399/106 |

FOREIGN PATENT DOCUMENTS

| | | | |
|---|---|---|---|
| EP | 1 233 311 A2 | | 2/2002 |
| JP | 3 1179 A | * | 1/1991 |

* cited by examiner

*Primary Examiner*—Joan Pendegrass
(74) *Attorney, Agent, or Firm*—Richard F. Spooner

(57) ABSTRACT

This invention relates to the packaging and subsequent removal of dry marking materials that tend to clump or bridge when shipped or stored in containers. Human operators are presently instructed to agitate such containers before installation into a marking engine but such agitation is unreliable. The present invention involves placement of agitation vanes on a displaceable inner seal within the cartridge such that such vanes will break apart clumps and bridges of the marking material during installation of the container upon the marking engine.

35 Claims, 10 Drawing Sheets

DRY INK REPLENISHMENT BOTTLE WITH INTERNAL PLUG AGITATION DEVICE

CROSS REFERENCE TO RELATED APPLICATIONS

Reference is made to commonly-assigned U.S. patent application No. D/A1155Q, filed concurrently herewith, entitled INTERNAL AGITATING MECHANISM FOR AGITATING MATERIALS WITHIN SEALED CONTAINERS, by Litwiller.

BACKGROUND OF THE INVENTION

This invention relates to the packaging and subsequent removal of dry marking materials that tend to clump or bridge when shipped or stored in containers. Dry marking materials such as electrophotographic toners are packaged and shipped in particulate form and other dry marking materials such as dry ink jet waxy solids may be shipped in pelletized or granulated form. Such dry marking materials typically settle and become more densely packed over time. A frequent consequence of such dense packing is often the formation of clumps and bridges formed of the materials within the containers. Agitating and/or aerating the materials before use can restore the desired density, consistency and flow characteristics. The present invention deals with a novel apparatus and method for providing in situ agitation and aeration within a dry marking material cartridge. This apparatus and method obviates the need for human intervention such as shaking or tapping a container, thereby making the degree and type of agitation more reliable.

Although various dry marking materials are contemplated for use with the present invention, the invention will be described in relation to sealed containers that transport and load electrophotographic toners. Other dry marking materials that may benefit from the present invention include, without limitation, waxy colorants, solid ink jet colorants, ionographic inks, and any other dry ink-like product that ships in a substantially non-liquid form.

Generally, in the process of electrostatographic printing, a photoconductive insulating member is charged to a substantially uniform potential to sensitize the surface thereof. The charged portion of the photoconductive insulating layer is thereafter exposed to a light image of an original document to reproduced. This records an electrostatic latent image on the photoconductive member corresponding to the information areas contained within the original document. Alternatively, in a printing application, the electrostatic latent image may be created electronically by exposure of the charged photoconductive layer by an electronically controlled laser beam or light emitting diodes. After recording the electrostatic latent image on the photoconductive member, the latent image is developed by bringing a developer material charged of opposite polarity into contact therewith. In such processes the developer material may comprise a mixture of carrier particles and toner particles or toner particles alone (both these single component and dual component development systems shall hereinafter be called "toner"). Toner particles are attracted to the electrostatic latent image to form a toner powder image that is subsequently transferred to copy sheet and thereafter permanently affixed to copy sheet by fusing.

In such a printing machines, the toner material is consumed in a development process and must be periodically replaced within the development system in order to sustain continuous operation of the machine. Various techniques have been used in the past to replenish the toner supply. Initially, new toner material was added directly from supply bottles or containers by pouring to the developer station located within the body of the automatic reproducing machine. The addition of such gross amounts of toner material altered the triboelectric relationship between the toner and the carrier in the developer station, thereby resulting in reduced charging efficiency of the individual toner particles and accordingly a reduction of the development efficiency when developing the electrostatographic latent image on the image bearing surface. In addition, the pouring process was both wasteful and dirty in that some of the toner particles became airborne and would tend to migrate into the surrounding area and other parts of the machine. Accordingly, separate toner hoppers with a dispensing mechanism for adding the toner from the hopper to the developer station in the printing machines on a regular or as needed basis have been provided. In addition, it has become common practice to provide replenishment toner supplies in a sealed container that, when placed in the printing machine, can be automatically opened to dispense toner into the toner hopper. In some of these designs, the toner cartridge may itself serve as the toner hopper. After this type of toner cartridge is mated to the printing machine at an appropriate receptacle, mechanisms are inserted into the toner cartridge that serve to transport the toner from the toner cartridge into the developer station or an intermediate toner hopper on a regulated basis. See, U.S. Pat. No. 5,903,806 issued to Matsunka et al.; U.S. Pat. No. 5,678,121 issued to Meetze et al.; and U.S. Pat. No. 5,495,323 issued to Meetze.

In any design utilizing a customer replaceable toner cartridge for replenishment, one difficulty that arises is the uniform dispensing of the toner. In particular, toner particles are known to settle and clump during shipment and storage. This clumping phenomenon is caused for a variety of reasons: 1) particles of smaller size can fill and pack spaces between larger articles; 2) toner particles are often tacky; and 3) the electrostatic properties of toner particles enable charge attractions between particles. The result is often agglomerations, or clumps, of particles within the toner cartridge. These agglomerations often compact and form bridging structures within the toner cartridge, and such bridging structures adhere to the sides of the toner cartridges. Simple probes and augers as disclosed in patents such as U.S. Pat. No. 5,903,806 issued to Matsunka et al., U.S. Pat. No. 5,678,121 issued to Meetze et al., and U.S. Pat. No. 5,495,323 issued to Meetze may penetrate such agglomerations and bridging structures but do not break them up. Even rotation of the cartridges after mating onto a printing machine toner receptacle does not impart enough energy to shake the clumped toner particles apart from its various clumps and bridging structures. In the worst case, toner may be entirely prevented from exiting the cartridge unless it is agitated. Since toner cost is a major component of the total cost of printing, any significant amount of toner left in a toner cartridge significantly increases the effective cost of using the printer. Worse, customers that do not receive the expected print volume from a cartridge may assume that the cartridge is faulty and make a warranty claim. In other cases, such customers have been known to make a service call that consumes valuable service and technician time.

In response to the above problems related to removal of substantially all toner from toner cartridges, various devices and procedures have been developed. One effective procedure when performed correctly is simply the shaking of a toner cartridge by human operators prior to mating the cartridge with the printing machine receptacle. However, many operators do not read the instructions and do not know or remember that toner cartridges need to be shaken. In addition, even when human operators read instructions, humans inevitably interpret product instructions subjectively such that an instruction to "vigorously agitate" a cartridge may lead to too much force by a few operators and too little by others. The result is that some cartridges are shaken or pounded hard enough to be damaged while others are not shaken enough to break up clumps and bridges that may have formed. Once the cartridge is mated to the receiving receptacle while the toner particles remain clumped and bridged, the operator is left with several choices: One is to leave the cartridge as is and to risk failure of toner transfer from the cartridge, wasting toner and/or believing that the printing system is consuming too much toner. A second choice is removal of the cartridge with its seals open, thereby risking contaminating the toner itself plus spilling the difficult-to-clean particles. A third choice is to try to strike, squeeze, or otherwise agitate the toner cartridge in situ. In addition to the probability that some toner nevertheless remains within the cartridge, such agitation in situ risks damage to the mating receptacle and associated parts of the printing machine. The end result is a frequent waste of valuable toner and a resulting increase in the costs of operating the printing machines plus the risk of warranty and service events.

For toner cartridges that are mounted onto printing machines in order that toner be extracted in a regulated fashion from the cartridges, such cartridges are now often cylindrical in shape with spiral ribs located on the inside peripheral walls of the cartridges. An example of such prior art cartridges is shown in U.S. Pat. No. 5,495,323 issued to Meetze incorporated and is hereby incorporated by reference. See also, U.S. Pat. No. 5,903,806 issued to Matsuoka et al. and U.S. Pat. No. 5,576,816 issued to Staudt et al. that both disclose substantially cylindrical toner cartridges having on their peripheral surface a spiral groove. The toner cartridge and the receiving apparatus operate to rotate the cartridge and to thereby transport the toner within the spiral groove. The apparatus includes a supplying element in the form of an opening and a regulating device. Although toner cartridges with such spiral grooves are effective in urging toward the mouth of the cartridge, such grooves by themselves do little to break up the clumps or bridging described above. Even when the apparatus includes a probe, auger, or similar device that penetrates the stored toner in a cartridge, current designs place such probes only along the central axis of the cartridge. Toner clumped or agglomerated along the periphery of the toner cartridge may not be jostled or mixed by either the rotation of the cartridge or by the probe itself.

Turning now to FIG. 1, a toner cartridge of the prior art is shown. Specifically, FIG. 1 shows the container cap portion 110 of prior art cartridge 90 from U.S. Pat. No. 5,576,816 separated from bottle portion 98. The circumference of container cap 110 is separated into quarters by radial protrusions 112. Pockets 124 are the spaces formed within the ring of container cap 110 by the four protrusions. Bore hole 274 (not labeled in U.S. Pat. No. 5,576,816 is shown at base of the visible portion of protrusions 112. More details concerning bore hole 274 are set forth below in relation to prior art FIG. 2. Experience shows that toner at times becomes packed in pockets 124, particularly when the cartridge has been shipped or stored with that portion of cartridge 110 lower than the rest of the cartridge. Also, no matter how shipped and stored, toner may clump and form bridges in portions of bottle 98. With adequate shaking by human operators prior to installation, such packed, clumped, and bridged toner becomes loose and aerated. However, as discussed above, some operators forget to shake vigorously. Vigorous shaking is particularly necessary when toner powders have packed into pockets 124.

Turning now to prior art FIG. 2, a plan view of the same prior art container shown in FIG. 1 shows more details of container cap 110. In this view, container cap 110 is shown attached to bottle portion 98 of cartridge 90. U.S. Pat. No. 5,576,816 teaches the use of two seals to keep toner particles within bottle 98. Outer seal 136 is a perforable seal filling large outer bore 272. Inner seal 140 fills and seals small bore 274. As taught in U.S. Pat. No. 5,576,816, Inner seal 140 and outer seal 136 cooperate to keep contamination out of cartridge 110 and toner particles within. Specifically, upon installation of cartridge 110 onto the printing system, auger 194, which is contained inside tube 144, perforates outer seal 136 and contacts inner seal 140. Since outer seal 136 comprises flexible elastic material, it maintains a tight seal around tube 144 as tube 144 is pushed further into cartridge 110. Tube 144 has a diameter approximately equal to small bore 274. As auger 194 pushes against inner seal 140, it pushes the seal into the interior of bottle 98. Inner seal 140 may either fall freely into bottle 98 or may remain attached to the tip of auger 194, depending upon the design of inner seal 140 and the tip of auger 194.

Returning to FIG. 1, the long dimension of protrusions 112 is in the direction of and approximately the length of container cap 110. The short dimension of protrusions 112, however, is less than the radius of container cap 110 since at least the diameter of bore 274 must be left unobstructed in order for auger 194 and tube 144 to be pushed into the interior of bottle 98. In the prior art example of protrusions 112 shown in FIG. 1, at least a portion of the long dimension of protrusions 112 extends toward bottle 98 without being attached to the sides of bores 274 or 272. Auger 194 pushes inner seal 140 through this open bore space into the interior of bottle 98. However, since the maximum diameter of inner seal 140 cannot exceed this bore space, nothing in prior art cartridge 90 acts to push or agitate any toner particles that have clumped or bridged inside pockets 124, especially along the outside perimeter of container cap 110. Moreover, since auger 194 remains centered along center line 122, auger 194 does not by itself help agitate or break up clumps and bridges along the perimeter of bottle 98. Even when inner seal 140 is pushed into bottle 98 and left to tumble as cartridge 90 rotates, there is no assurance that tumbling inner seal 140 will contact toner along the entire length of bottle 98. Indeed, spiral rib 104 is designed to urge all tumbling objects inside bottle 98, including both toner and any tumbling inner seal 140, toward container cap 110 rather than toward the end of bottle 98 away from container cap 110. In sum, even prior art cartridges such as cartridge 90 that receive penetrating augers down their center lines are not made with apparatus to agitate toner clumps and bridges formed along the outside perimeter of the cartridge or within pockets of their container caps. The design of these prior art cartridges relies upon human operators to shake and agitate the cartridges prior to installation in order to break apart such clumps and bridges.

At least one prior art device employed a helical member such as a spring inside the toner cartridge for the express purpose of breaking up clumps, bridges, and other agglomerations. In U.S. Pat. No. 4,739,907, issued to Gallant, a cylindrical toner cartridge includes a dispensing opening at one end and an integral toner transport, mixing, and anti-bridging member rotatably supported within the container. The transport, mixing, and anti-bridging member comprises a first coiled spring element having a cross section substantially the same as the cross section of the cartridge and freely rotatable therein, which spring is wound in the direction to transport toner along its length toward the dispensing opening. The member also comprises a second coiled spring element having a cross section substantially smaller than the first spring element but being substantially concentrically positioned and being attached to the first spring element but wound in a direction opposite to the first spring element. In this manner, rotation of the cartridge while the spring members remain substantially fixed results in the scraping of clumped toner from the sides of the cartridge and mixing and penetration of any agglomerations and bridges within the interior of the cartridge by the inner spring.

As described above, conventional toners tend to clump and form bridges. Additionally, recent advances in imaging and toner production have led to smaller toner particles that now may average less than 10 microns. In order to overcome electrostatic forces that tend to attract particles together, a substantial amount of aeration of the toner particles is preferred. It would be advantageous, therefore, to devise a toner cartridge assembly that both aerates toner and that automatically breaks up clumps and bridges within the toner without the need for human operators to shake or otherwise agitate the container prior to installation.

Although the above background for the present invention and several of its embodiments are explained in relation to toner cartridges, the present invention is believed to have wide applicability to any dry marking material prone to clump or form bridges in the shipping cartridge. In particular and without limitation, the present invention applies to dry ink jet marking materials of the type comprised of waxy solid material that marks once melted and placed on the media to be marked.

SUMMARY OF THE INVENTION

One embodiment of the present invention comprises a device for storing a supply of marking materials for use in a marking system, comprising: a. an open ended container defining a chamber in communication with the open end thereof with the marking materials being stored in the chamber of said container, said chamber having an end opposite the open end, a center point of such opposite end, a center point of the internal opening at the open end, and an axis running from the center of the opening at the open end to the center of the opposite end; b. an internal seal attached to the open end of said container, said internal seal having a body closely conforming to the internal opening of said container, said internal seal being removable from the open end of said container by displacement of said internal seal into the chamber of said container; and c. a vane attached to the body of said internal seal and extending away from the axis of the chamber.

Another embodiment of the present invention comprises an internal seal for a container for storing a supply of marking materials for use in a marking system, said storage device having an internal opening having a rim, and said internal seal comprising: a. a body closely conforming to the internal opening of the container, said internal seal being removable from the internal opening and said internal seal having a central axis running generally perpendicularly to the rim; and c. a vane attached to the body of the internal seal and extending away from the axis of the body.

Yet another embodiment of the present invention is a marking system with a supply of marking materials, said marking machine comprising: a. an open container defining a chamber in communication with the open end thereof with the marking materials being stored in the chamber of said container, said chamber having an end opposite the open end, a center point of such opposite end, a center point of the internal opening at the open end, and an axis running from the center of the opening at the open end to the center of the opposite end; b. an internal seal attached to the open end of said container, said internal seal having a body closely conforming to the internal opening of said container, said internal seal being removable from the open end of said container by displacement of said internal seal into the chamber of said container; and c. a vane attached to the body of said internal seal and extending away from the axis of the chamber.

DETAILED DESCRIPTION OF THE DRAWINGS

While the present invention will hereinafter be described in connection with several embodiments and methods of use, it will be understood that this is not intended to limit the invention to these embodiments and methods of use. On the contrary, the following description is intended to cover all alternatives, modifications and equivalents, as may be included within the spirit and scope of the invention as defined by the appended claims.

Inasmuch as the art of electrophotographic printing is well known, the various processing stations employed in the FIG. 10 printing machine will be shown hereinafter schematically and their operation described briefly with reference thereto.

Figure 10:
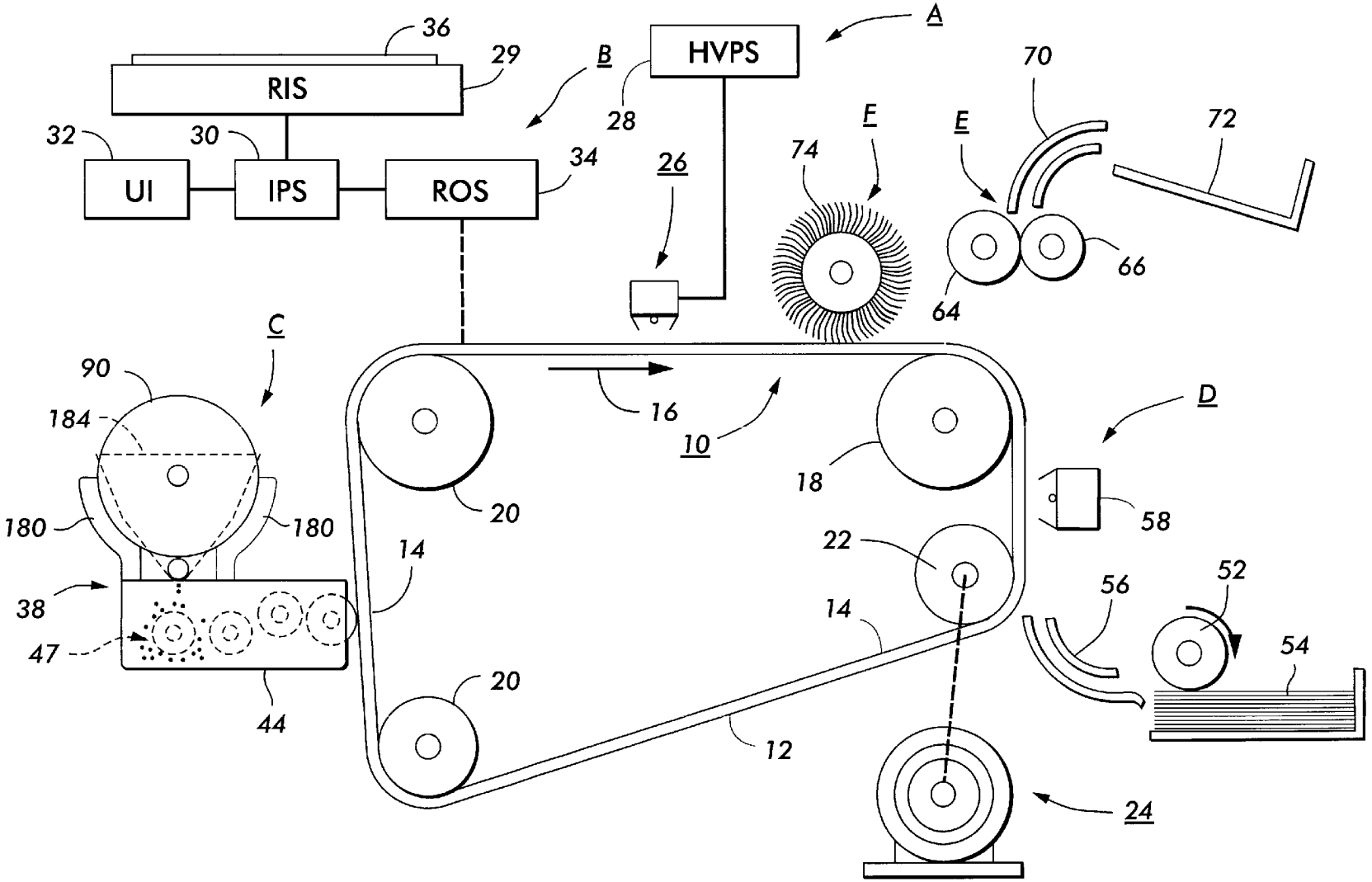
FIG. 10 is a schematic elevational view of an illustrative marking machine of the present invention.

Referring initially to FIG. 10, there is shown an illustrative electrophotographic printing machine incorporating the development apparatus of the present invention therein. The printing machine incorporates a photoreceptor 10 in the form of a belt having a photoconductive surface layer 12 on an electroconductive substrate 14. Preferably the surface 12 is made from a selenium alloy. The substrate 14 is preferably made from an aluminum alloy which is electrically grounded. The belt is driven by means of motor 24 along a path defined by rollers 18, 20 and 22, the direction of movement being counter-clockwise as viewed and as shown by arrow 16. Initially a portion of the belt 10 passes through a charge station A at which a corona generator 26 charges surface 12 to a relatively high, substantially uniform, potential. A high voltage power supply 28 is coupled to device 26.

Next, the charged portion of photoconductive surface 12 is advanced through exposure station B. At exposure station B, an original document 36 is positioned on a raster input scanner (RIS), indicated generally by the reference numeral 29. The RIS contains document illumination lamps, optics, a mechanical scanning drive, and a charge coupled device (CCD array). The RIS captures the entire original document and converts it to a series of raster scan lines and (for color printing) measures a set of primary color densities, i.e., red, green and blue densities at each point of the original document. This information is transmitted to an image processing system (IPS), indicated generally by the reference numeral 30. IPS 30 is the control electronics which prepare and manage the image data flow to raster output scanner (ROS), indicated generally by the reference numeral 34. A user interface (UI), indicated generally by the reference numeral 32, is in communication with the IPS. The UI enables the operator to control the various operator adjustable functions. The output signal from the UI is transmitted to IPS 30. The signal corresponding to the desired image is transmitted from IPS 30 to ROS 34, which creates the output copy image. ROS 34 lays out the image in a series of horizontal scan lines with each line having a specified number of pixels per inch. The ROS includes a laser having a rotating polygon mirror block associated therewith. The ROS exposes the charged photoconductive surface of the printer.

After the electrostatic latent image has been recorded on photoconductive surface 12, belt 10 advances the latent image to development station C as shown in FIG. 10. At development station C, a development system 38, develops the latent image recorded on the photoconductive surface. The chamber in developer housing 44 stores a supply of developer material 47. The developer material may be a two component developer material of at least magnetic carrier granules having toner particles adhering triboelectrically thereto. It should be appreciated that the developer material may likewise comprise a one component developer material consisting primarily of toner particles.

Again referring to FIG. 10, after the electrostatic latent image has been developed, belt 10 advances the developed image to transfer station D, at which a copy sheet 54 is advanced by roll 52 and guides 56 into contact with the developed image on belt 10. A corona generator 58 is used to spray ions onto the back of the sheet so as to attract the toner image from belt 10 the sheet. As the belt turns around roller 18, the sheet is stripped therefrom with the toner image thereon.

After transfer, the sheet is advanced by a conveyor (not shown) to fusing station E. Fusing station E includes a heated fuser roller 64 and a back-up roller 66. The sheet passes between fuser roller 64 and back-up roller 66 with the toner powder image contacting fuser roller 64. In this way, the toner powder image is permanently affixed to the sheet. After fusing, the sheet advances through chute 70 to catch tray 72 for subsequent removal from the printing machine by the operator.

After the sheet is separated from photoconductive surface 12 of belt 10, the residual toner particles adhering to photoconductive surface 12 are removed therefrom at cleaning station F by a rotatably mounted fibrous brush 74 in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 1:
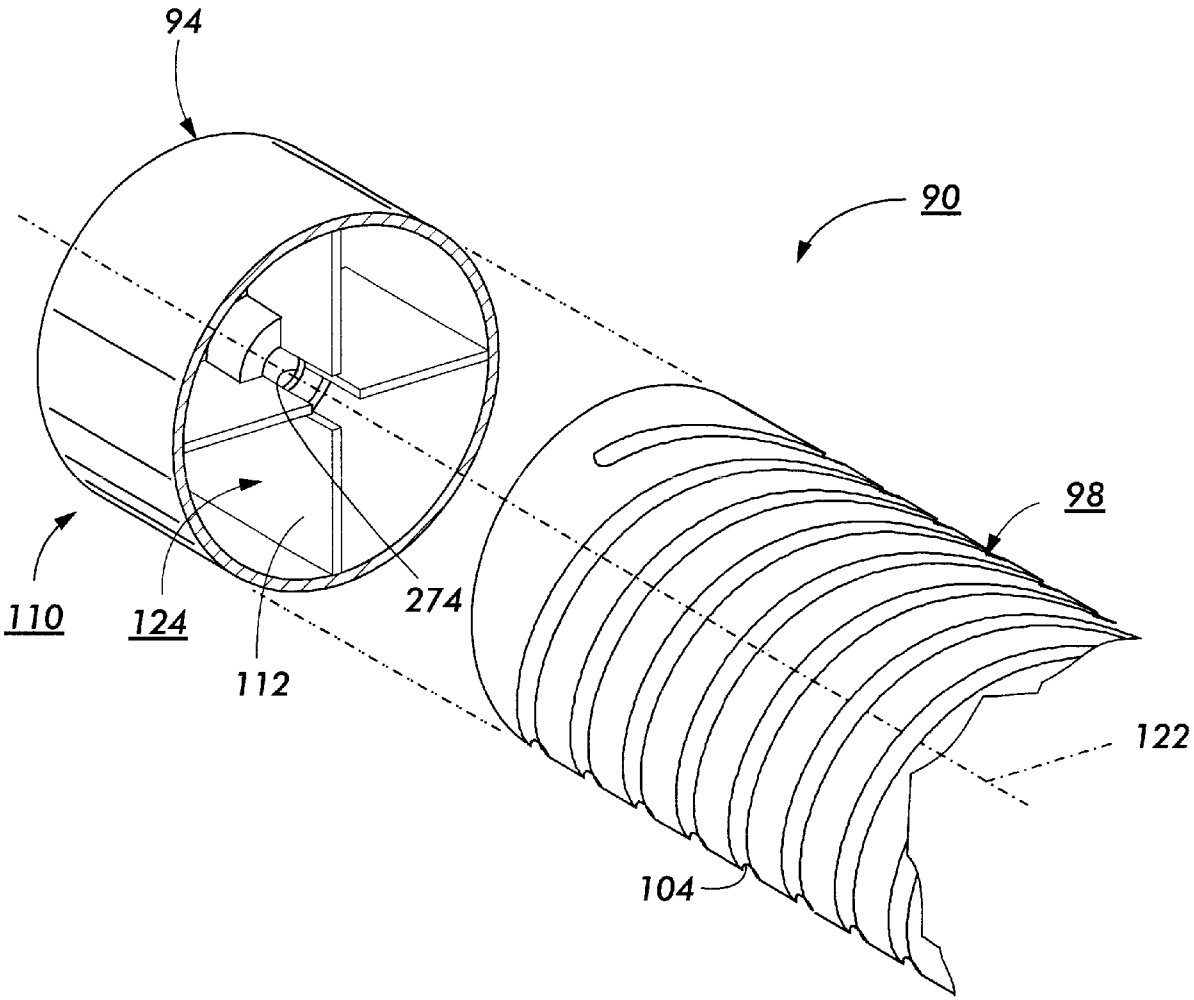
FIG. 1 PRIOR ART
FIG. 1 is an exploded perspective view of a container of the prior art.
Figure 3:
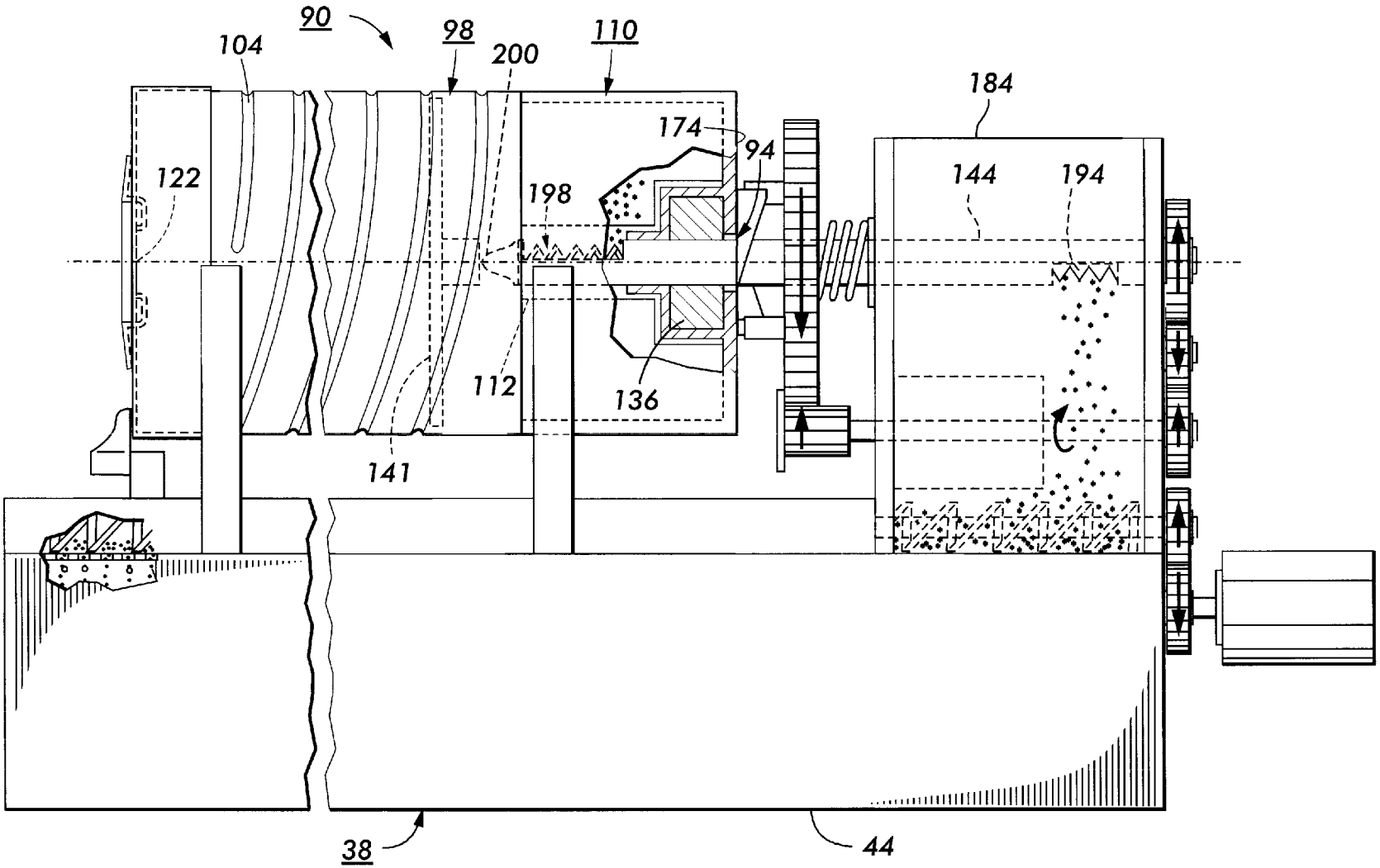
FIG. 3 is a plan view showing a development apparatus of the present invention.

Turning to FIG. 3, a plan view of developer station 38 is shown with cartridge 90 partially attached. Auger 194 is shown inserted into cartridge 90 through outer seal 136. Inner seal 141 of the present invention is shown attached to the tip of auger 194 and pushed into the interior of bottle 98. Auger 194 thus comprises a probe that travels into the interior of the chamber of cartridge 90. FIG. 3 is closely based upon FIG. 1 of U.S. Pat. No. 5,576,816, which is incorporated herein in its entirety. Since U.S. Pat. No. 5,576,816 discusses in detail the operation of developer station 38 and its components, only a brief summary will be provided below. In brief, toner falls into tube 144 from cartridge 90 through opening 198. Auger 194 conveys the toner into developer sump housing 184 of the printing machine. Subsequently, the toner is conveyed into developer housing 44. The apparatus within developer housing 44 and the photoreceptor 10 cooperate to convert latent images on photoreceptor 10 into visible images as described above.

Figure 2:
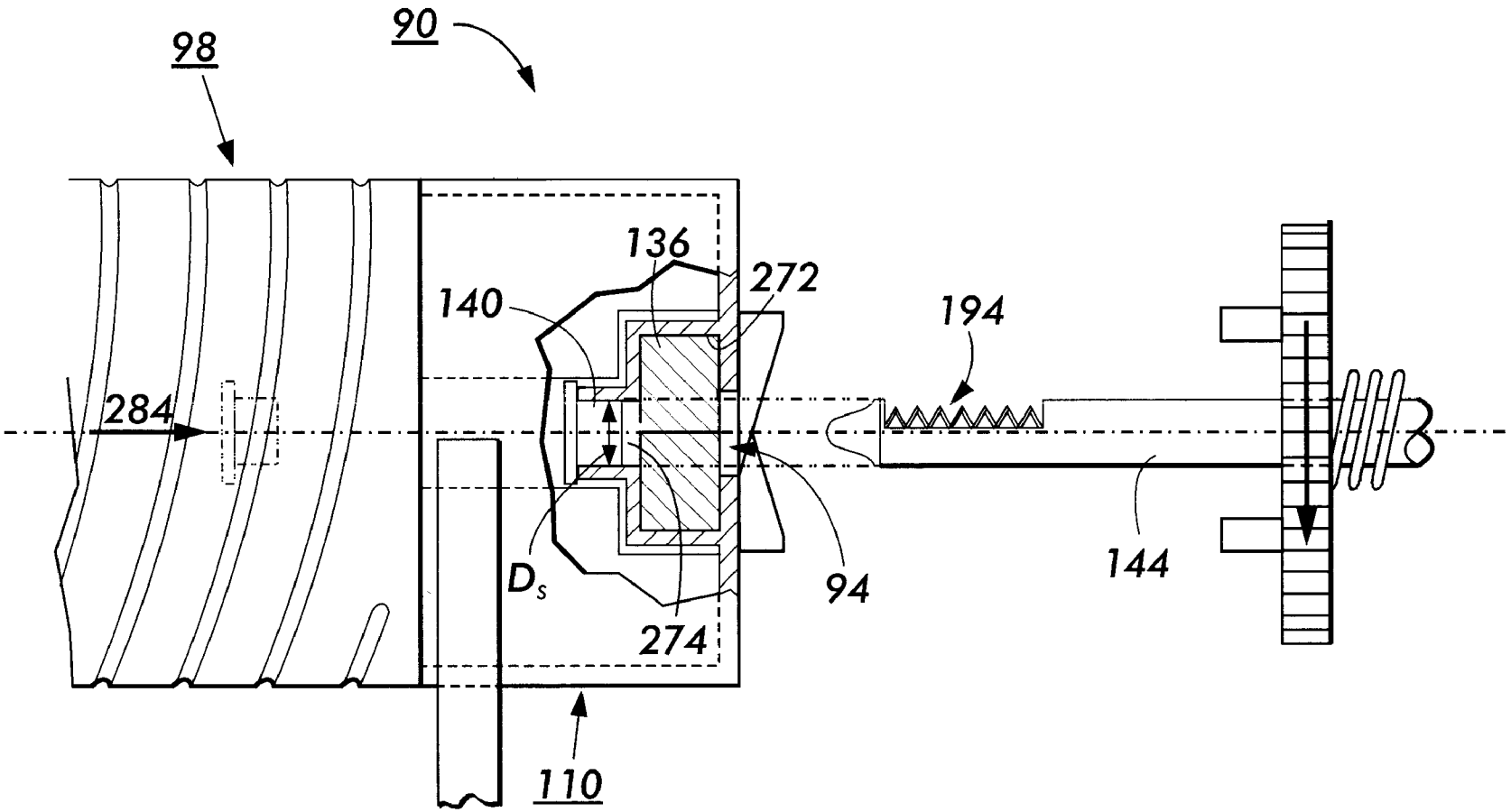
FIG. 2 PRIOR ART
FIG. 2 is a plan view showing a development apparatus of the prior art.

The present invention involves inner, or internal, seal 141 shown in FIG. 3 to be nudged by the tip of auger 194 which serves as a probe into the interior chamber of cartridge 90. When compared to inner seals of the prior art such as inner seal 140 shown in prior art FIG. 2, inner seal 141 of the present invention has members, or vanes, that extend substantially outward from center line 122 towards the perimeter of bottle 98. In this manner, the extended portions of inner seal 141 sweep through the clumps and bridges of toner that may form even along the periphery of cartridge 90.

Figure 4:
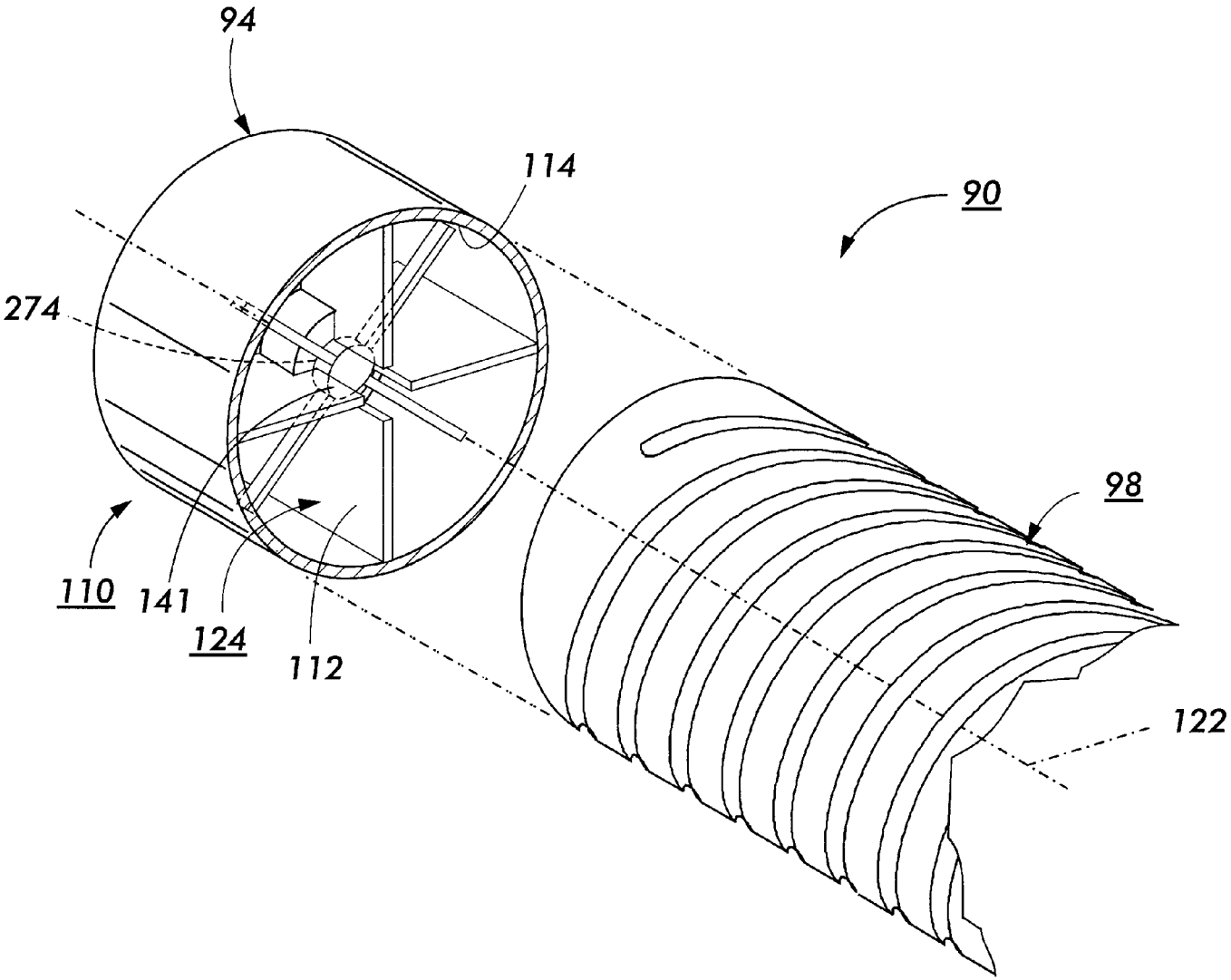
FIG. 4 is an exploded perspective view of a container of the present invention.

An elevated perspective view of inner seal 141 and its initial placement within cartridge 90 is shown in FIG. 4. As shown, inner seal 141 has an equal number of extensions, 142A–142D, as there are radial protrusions 112. These extensions, or vanes, can take any shape and may extend any length from the hub of inner seal 141 as desired. Preferably but not necessarily, vanes 142A–142D are positioned to approximately bisect pockets 124. If protrusions 112 are curved or spiraled to further urge toner toward opening 198 in tube 144 (shown in FIG. 3 above), then vanes 142A–142D are preferably though not necessarily similarly curved.

As discussed above in relation to FIG. 1, toner particles are particularly prone to pack and form clumps and bridges within pockets 124. In contrast to prior art seal 140 shown in FIG. 2, vanes 142A–142D of the inner seal of the present invention extend outward into pockets 124. Vanes 142A–142D may extend all the way to the periphery of container cap 110, which is the end section of cartridge 90 proximate to open end at bore 274. Also, as discussed above, the initial position of the inner seal over bore 274 places vanes 142A–142D proximate to the end 94 of cartridge 90 through which auger 194 penetrates the cartridge. In this manner, when inner seal 141 is displayed from bore 274 in the manner discussed above in relation to prior art inner seals, then vanes 142A–142D push and sweep toner clumps and bridges out of pockets 124. Also to be noted, as shown in FIG. 4, is that vanes 142A–142D are initially positioned to fit through the gaps formed between the edges of protrusions 112 proximate to center line 122.

Figure 5:
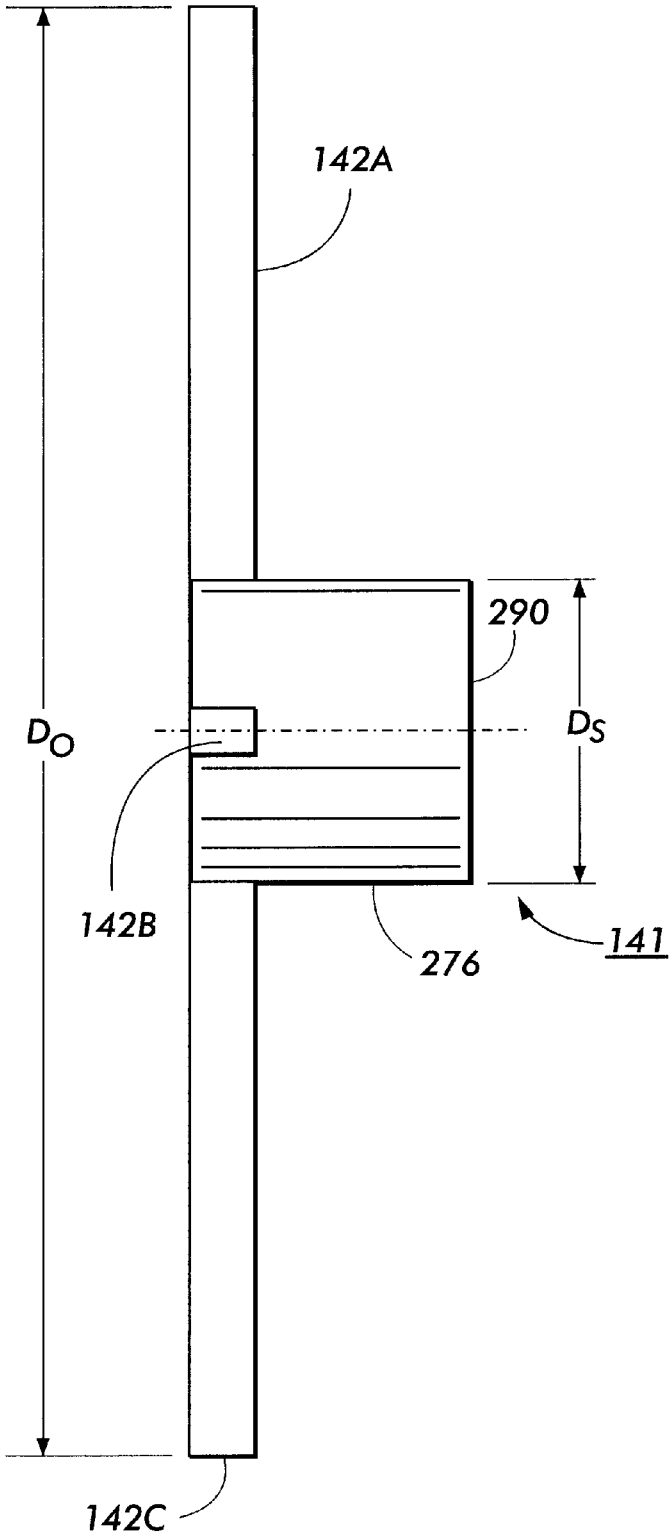
FIG. 5 is a plan view of an inner seal of the present invention.

Turning now to FIG. 5, more details of inner seal 141 are shown. Diameter $D_S$ of central plug 276 approximates the diameter of bore 274. Central plug 276 forms the main body of inner seal 141 and serves the same function as its counterpart in prior art inner seal 140 discussed above in relation to FIGS. 1 and 2. In contrast to the prior art inner seal 140, however, inner seal 141 of the present invention need not have a lip to prevent it from being pushed into bore 274. Instead, vanes 142A–142D may serve this function. In addition, as discussed above, vanes 142A–142D serve to break up clumps and bridges formed by toner, particularly those clumps and bridges that have formed inside pockets 124 shown in FIG. 4. As shown in FIG. 5, vanes 142A–142D may span any diameter $D_O$ up to nearly the diameter of container cap 110. The larger the dimension of $D_O$, the greater its ability to break apart clumps and bridges of toner. Also, it should be noted that although the example given of the present invention shows four vanes 142A–142D, any number and shape of vanes are possible as long as such vanes fit through the spaces between protrusions 112 as discussed above. Of course, if a cartridge 90 does not include protrusions 112, then the shape and size of vanes 142 are not restricted by such protrusions. As with prior art inner seal 140 taught in U.S. Pat. No. 5,576,816, novel inner seal 141 with its vanes 142A–142D may be made of any suitable plastic material, particularly any thermoplastic resin suitable for an injection mold processing.

Vanes 142A–142D therefore represent an improvement over the prior art and enable the inner seal of the present invention to serve a function different from and in addition to the functions of inner seals of the prior art. In this manner, the need of human operators to shake and agitate cartridge 90 prior to mounting it onto a printing system is substantially eliminated.

Turning now to 6, the interaction of inner seal 141 with its vanes 142A–142D and auger 194 is shown. In this plan view, auger 194 has pushed seal 141 out of bore 274, past protrusions 112, and into bottle 98. Once vanes 142A–142D have cleared protrusions 112, auger 194 is free to rotate. Toner 92 is shown falling into opening 198 such that auger 194 begins the transport of toner 92 to the developer housing as discussed above. Rotation of auger 194 with inner seal 141 attached to its tip 200 is advantageous since vanes 142A–142D rotate with auger 194, thereby further agitating and aerating the tumbling toner and further breaking apart any clumps and bridges.

Although it is possible for inner seal 141 to not be fastened to tip 200 of auger 194, this would result in inner seal 141 falling into bottle 98. The beneficial effects of rotating vanes 142A–142D would therefore not be obtained. Worse, there may be some possibility that vanes 142A–142D could become detached from body 276 of seal 141 and to ultimately be urged toward opening 198 and auger 194. Accordingly, it is preferred that inner seal 141 remain attached to tip 200 once pushed away from bore 274. There are many techniques to achieve such attachment, including adhesives and shapes by which body 276 of inner seal 141 mechanically grips tip 200 of auger 194. An example of such a mechanical gripping configuration is taught in U.S. Pat. No. 6,137,972 issued to Playfair et al. which is hereby incorporated by reference.

Figure 6:
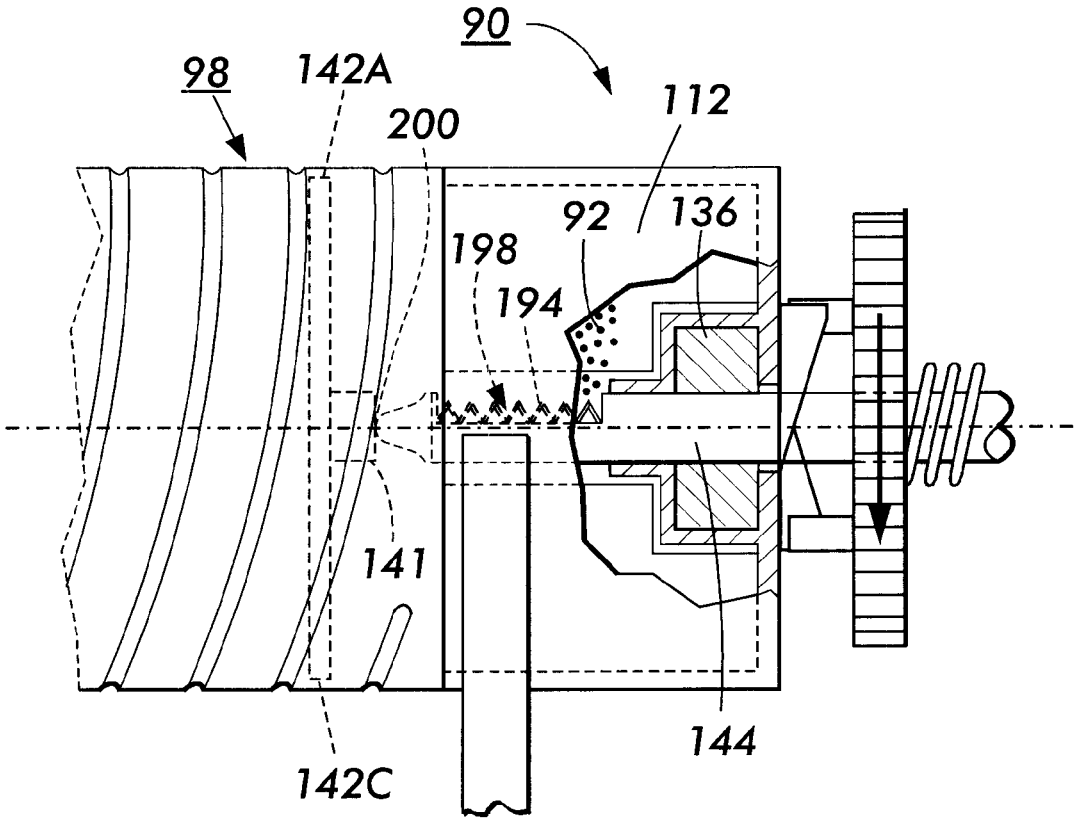
FIG. 6 is a partial plan view of a container of the present invention.
Figure 7:
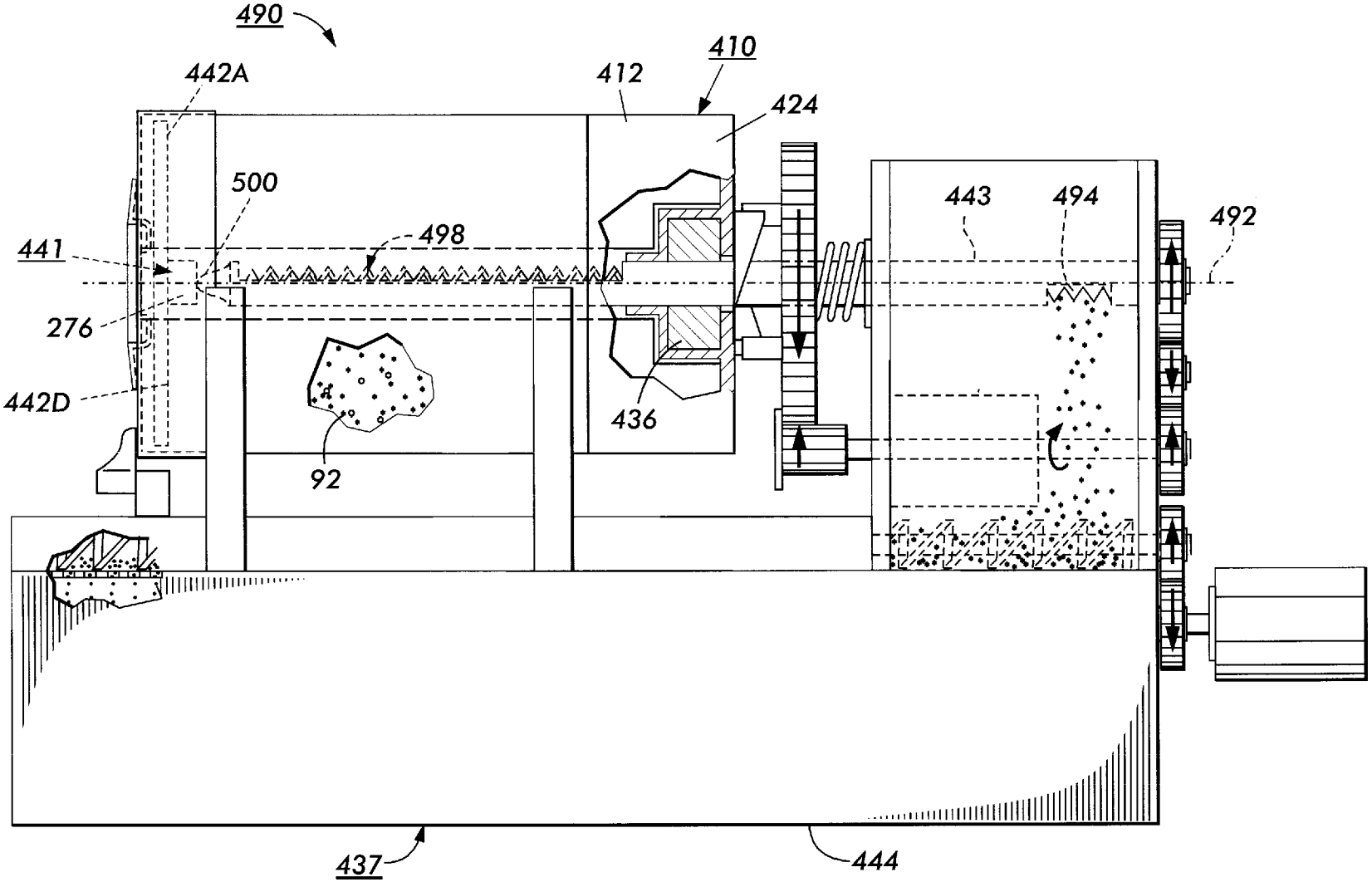
FIG. 7 is a plan view of a development apparatus of the present invention.

Turning now to FIG. 7, the benefits of pushing inner seal 141 all the way through cartridge 90 is shown. If protrusions 412 extend the entire length of cartridge 490 as shown in FIG. 11 of U.S. Pat. No. 5,576,816, then the spiral ribs are not necessary. In this plan view, the design of auger 494 and tube 443 extends each almost the entire length of cartridge 490. Opening 498 in tube 443 similarly is greatly extended when compared to the opening 98 shown in FIGS. 2, 3 and 6. As discussed above in relation to FIG. 6, auger 494 with its tip 500 can begin rotation once vanes 442A–442D are pushed by tip 500 beyond protrusions 412 that are contained within container cap 410. In this manner, vanes 442A–442D are rotated by auger 494 down the entire length of cartridge 490. The result is that initial non-rotational movement of vanes 442A–442D sweeps and pushes toner out of pockets 424 formed between protrusions 412. Thereafter, rotational motion increases the mixing and agitating function of vanes 442A–442D. Of course, even if vanes 442A–442D do not rotate when pushed through the length of cartridge 490, they still serve to break up clumps and bridges. Any such clumps and bridges that are not entirely dissipated by the traverse of vanes 442A–44D have been loosened sufficiently that they will tumble and be broken apart by rotation of cartridge 490. If cartridge 490 has spiral ribs as discussed above (not shown in FIG. 7), then such spiral ribs further ensure that all clumps and bridges are dissipated. Also, if protrusions 412 extend the entire length of cartridge 490 as shown in FIG. 11 of U.S. Pat. No. 5,576,816, then vanes 442A–442D should preferably be attached to the tip of tube 443 in a non-rotational fashion. The beneficial effects of sweeping toner through pockets 424 nevertheless are realized.

Figure 8:
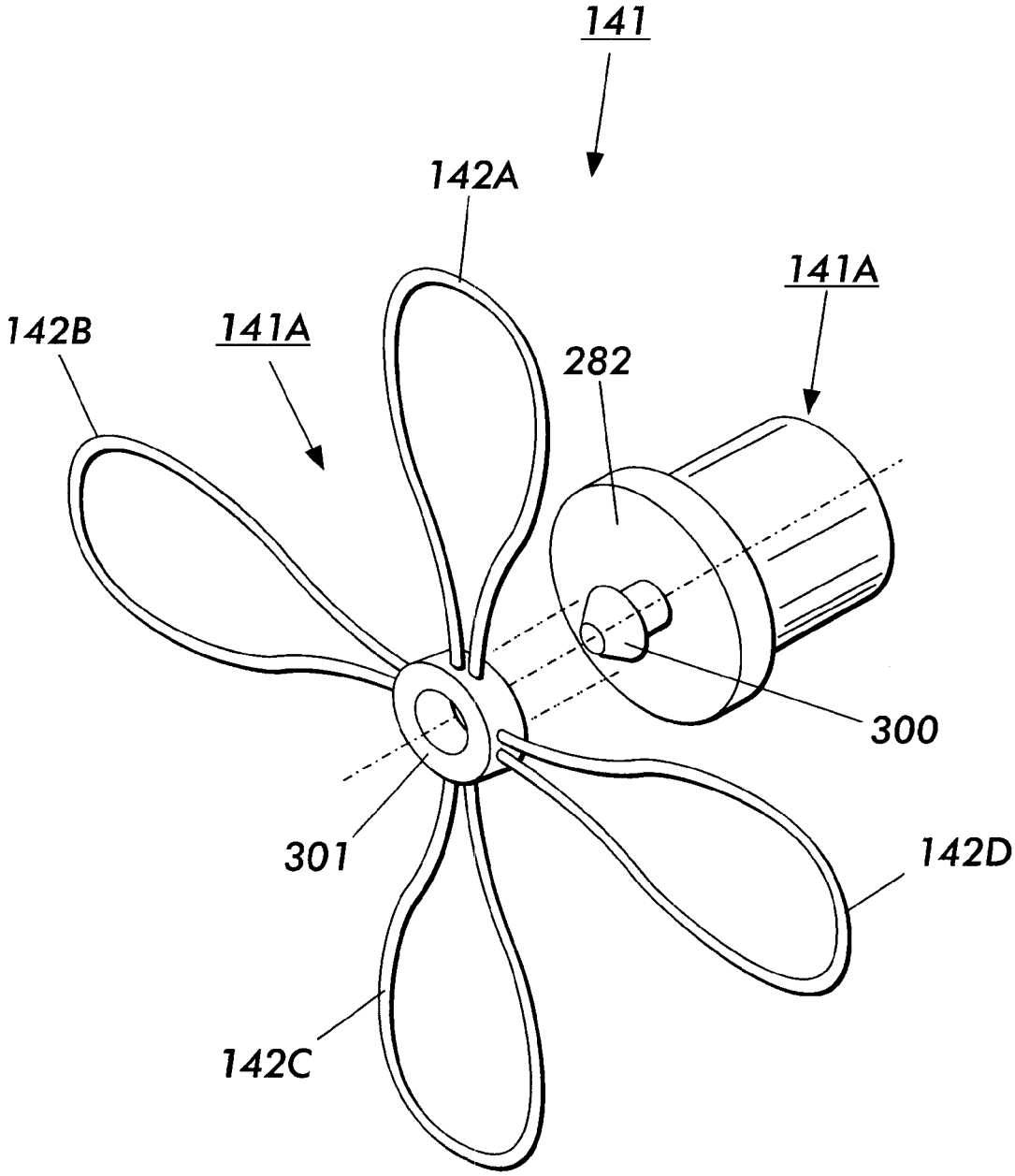
FIG. 8 is an exploded perspective view of an inner seal of the present invention.

Turning now to FIG. 8, an alternative embodiment of inner seal 141 is shown. In this elevated perspective view, inner seal 141 is comprised of two sections. Section 141A is essentially identical to the conventional prior art seal shown in U.S. Pat. No. 5,576,816. The only difference is an attachment fixture 300 located centrally on the face of end 282. In the embodiment shown, fixture 300 is simply a raised "button" knob suitable for a snap fastener to slip over. Section 141B comprises the vanes 142A–142D of the present invention. In this embodiment, vanes 142A–142D comprise wire-like protrusions arranged in flower petal-like pattern from central hub 301. Central hub 301 comprises a central bore sized to fit over and snap onto fixture 300. Once snapped onto such fixture, then section 141B with its vanes 142A–142D act in conjunction with section 141A as if both were molded from the same injection process.

Figure 9:
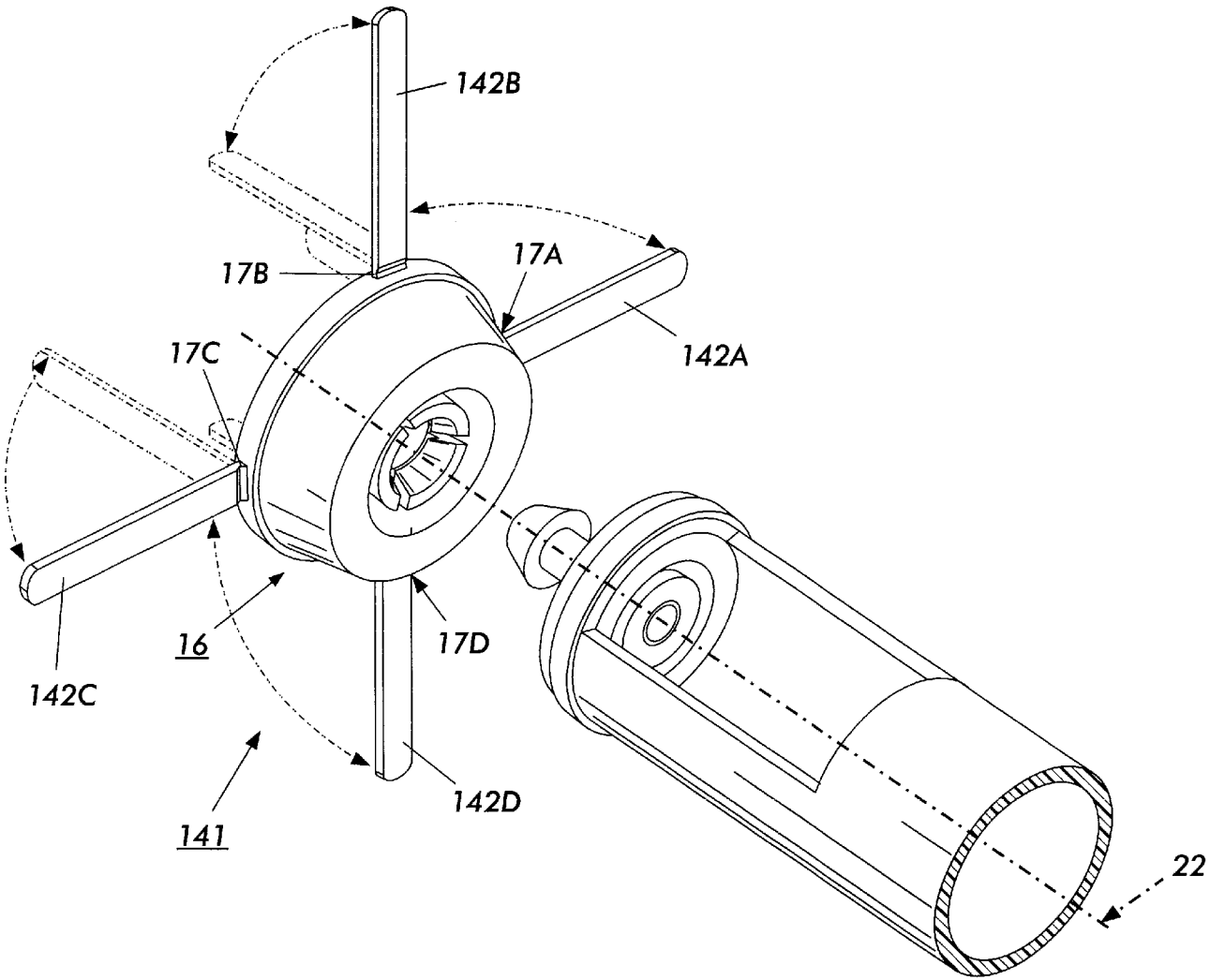
FIG. 9 is an elevated perspective view of an inner seal and a probe of the present invention.

Turning now to FIG. 9, yet another embodiment of an inner seal of the present invention is shown. This embodiment is based upon the inner seal taught in U.S. Pat. No. 6,1237,972 by Playfair et al. This embodiment of inner seal 141 shows that vanes 142A–142D are attached to the body of seal 16 by flexible hinges 17A–17D. These may be simple snap hinges molded of plastic. Hinges 17A–17D are capable of swinging vanes 141A–141D outward toward the perimeter of bottle 98 and folding the vanes backward along the axis 122 of cartridge 90. The purpose of the hinges is to position the vanes in a completely open position when inner seal 141 is first removed from bore 274 by auger 194. As taught by Playfair, however, body 16 is designed to remain attached to auger 194 and then to reseal bore 274 when the auger is removed from cartridge 90. Such removal of the auger and resealing involves the retraction of the auger from the closed end of bottle 90 toward the end with bore 274. The effect of hinges 17A–17D is to allow vanes 142A–142D to fold backward toward central axis 122 as the body 16 is retracted through unconsumed toner particles. The advantage of such retraction is that vanes 142A–142D when retracted will not push or recompress toner particles in the end of the cartridge toward bore 274.

In sum, a toner cartridge has been presented having an internal seal removable from the opening by pushing inwardly on the seal. The seal of the present invention has the advantages of prior art inner seals that seal toner inside the cartridge during shipment and storage and that is not susceptible to removal inadvertently. When combined with a perforable outer seal, such inner seal seals the cartridge during operation as well as during shipment and storage.

Also as with the prior art, the inner seal which is in contact with toner remains inside the enclosed cartridge and never need be contacted by human operators. In addition to these advantages, the novel inner seal of the present invention with its agitating vanes completely or at least substantially eliminates the need for human operators to shake and agitate toner bottles prior to installation. This improves customer satisfaction and saves possible warranty returns of toner cartridges and expensive service calls. When compared to known agitating devices and methods in the prior art, the present invention enables less reliance upon human operators. Moreover, the present invention can be implemented for relatively minor cost since the vanes of the present invention require minor increases in the amount of plastic consumed. Several embodiments of the improved inner seal have been shown, and it is clear that any number of additional shapes, sizes and embodiments are possible.

It is, therefore, evident that there has been provided in accordance with the present invention an improved inner seal for a marking material cartridge that fully satisfies the aims and advantages set forth above. While the invention has been described in conjunction with several embodiments, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. A device for storing a supply of marking materials for use in a marking system, comprising:

a. an open ended container defining a chamber in communication with the open end thereof with the marking materials being stored in the chamber of said container, said chamber having an end opposite the open end, a center point of such opposite end, a center point of the internal opening at the open end, and an axis running from the center of the opening at the open end to the center of the opposite end;

b. an internal seal attached to the open end of said container, said internal seal having a body closely conforming to the internal opening of said container, said internal seal being removable from the open end of said container by displacement of said internal seal into the chamber of said container; and c. a vane attached to the body of said internal seal and extending away from the axis of the chamber.

2. The device of claim 1, further comprising a plurality of vanes.

3. The device of claim 1, wherein the vane extends approximately perpendicularly to the axis of the chamber.

4. The device of claim 1, wherein the chamber has at least one side wall connecting the open end to the opposite end and wherein the vane extends proximately to the side wall.

5. The device of claim 1, wherein the vane comprises a substantially straight member.

6. The device of claim 1, wherein the vane comprises an arcurately shaped member.

7. The device of claim 1, wherein the vane comprises a wire-like loop member.

8. The device of claim 1, wherein:

a. the body of the internal seal further comprises an attachment fixture;

b. the vane comprises a member formed separately from the body of the internal seal that attaches to the body at the attachment fixture.

9. The device of claim 8, wherein:

a. the attachment fixture comprises a snap knob; and b. the vane further comprises a hub having a bore that snaps over the knob.

10. The device of claim 1, wherein the marking materials comprise electrophotographic toners.

11. The device of claim 1, wherein the marking materials comprise dry ink jet materials.

12. The device of claim 1, further comprising:

a. at least one side wall connecting the open end to the opposite end; and b. at least one radial protrusion extending inwardly from the side wall, wherein the protrusion approaches but does not reach the axis of the chamber.

13. The device of claim 12, further comprising a plurality of protrusions that, in conjunction with both the internal face of the open end of the container and the side wall, at least partially define a pocket between the protrusions and wherein the vane extends into the pocket so defined.

14. The device of claim 13, wherein:

a. the protrusions have a length dimension comprised of the length of the protrusions measured from the internal face of the open end along the direction parallel to the axis of the chamber; and b. before removal of the inner seal from the internal opening, at least a portion of the vane is situated within the pocket at a distance from the internal face of the open end less than the length dimension of the protrusions.

15. The device of claim 1, wherein the vane further comprises a hinge member that connects the vane to the body of the inner sea.

16. An internal seal for a container for storing a supply of marking materials for use in a marking system, said storage device having an internal opening having a rim, and said internal seal comprising:

a. a body closely conforming to the internal opening of the container, said internal seal being removable from the internal opening and said internal seal having a central axis running generally perpendicularly to the rim; and b. a vane attached to the body of the internal seal and extending away from the axis of the body.

17. The internal seal of claim 16, wherein the vane comprises a substantially straight member.

18. The internal seal of claim 16, wherein the vane comprises an arcurately shaped member.

19. The internal seal of claim 16, wherein the vane comprises a wire-like loop member.

20. The internal seal of claim 16, wherein:

a. the body of the internal seal further comprises an attachment fixture;

b. the vane comprises a member formed separately from the body of the internal seal that attaches to the body at the attachment fixture.

21. The internal seal of claim 20, wherein:

a. the attachment fixture comprises a snap knob; and b. the vane further comprises a hub having a bore that snaps over the knob.

22. The internal seal of claim 16, wherein the vane further comprises a hinge member that connects the vane to the body of the inner seal.

23. A marking system with a supply of marking materials, said marking machine comprising:

a. an open container defining a chamber in communication with the open end thereof with the marking materials being stored in the chamber of said container, said chamber having an end opposite the open end, a center point of such opposite end, a center point of the internal opening at the open end, and an axis running from the center of the opening at the open end to the center of the opposite end;

b. an internal seal attached to the open end of said container, said internal seal having a body closely conforming to the internal opening of said container, said internal seal being removable from the open end of said container by displacement of said internal seal into the chamber of said container; and c. a vane attached to the body of said internal seal and extending away from the axis of the chamber.

24. The marking machine of claim 23, further comprising a plurality of vanes.

25. The marking machine of claim 23, wherein the vane extends approximately perpendicularly to the axis of the chamber.

26. The marking machine of claim 23, wherein the chamber has at least one side wall connecting the open end to the opposite end and wherein the vane extends proximately to the side wall.

27. The marking machine of claim 23, wherein the vane further comprises a hinge member that connects the vane to the body of the inner sea.

28. The marking machine of claim 23, wherein the marking machine is an electrophotographic marking device.

29. The marking machine of claim 23, wherein the marking machine is a dry ink jet marking device.

30. The marking machine of claim 23, further comprising a probe that, upon installation of the marking material container, contacts the internal seal and displaces the internal seal into the chamber of said container.

31. The marking machine of claim 30, wherein the inner seal, when displaced by the probe, remains attached to the probe.

32. The marking machine of claim 31, wherein at least a portion of the probe travels into the chamber to a region closer to the opposite end than to the open end.

33. The marking machine of claim 31, wherein:

a. the probe further comprises a rotating element; and b. the inner seal, when displaced by the probe, is attached to the rotating member.

34. The marking machine of claim 30, wherein:

a. at least a portion of the probe travels into the chamber;

b. the portion that travels into the chamber is withdrawal from the chamber; and, upon withdrawal of the probe, the inner seal returns proximate to its initial position.

35. The marking machine or claim 34, wherein:

a. the vane further comprises a hinge connecting the vane with the inner seal body;

b. when the probe displaces and travels into the chamber, the vanes extend away from the axis of the chamber; and c. the vanes pivot on the hinge toward the opposite end of the chamber when the probe is being withdrawn from the chamber.

* * * * *